United States Patent [19]

Parson

[11] 3,999,628

[45] Dec. 28, 1976

[54] LADDER WITH INSULATED ELECTRICAL CIRCUIT

[76] Inventor: Jessie Parson, 27014 Yale, Inkster, Mich. 48141

[22] Filed: Mar. 15, 1976

[21] Appl. No.: 666,640

[52] U.S. Cl. ..... 182/46; 182/129

[51] Int. Cl.[2] ..... E06C 5/32

[58] Field of Search ..... 182/129, 48, 230

[56] References Cited

UNITED STATES PATENTS

| | | | |
|---|---|---|---|
| 2,683,957 | 7/1954 | Harms | 182/129 |
| 3,023,832 | 3/1962 | Silverman | 182/129 |

*Primary Examiner*—Reinaldo P. Machado
*Attorney, Agent, or Firm*—Allan J. Murray

[57] ABSTRACT

A first length of insulated electrically conductive wire is immovably secured to one section of an extension ladder, and has an electrical outlet on such section of said ladder; a spring-loaded, self-winding storage unit secured to another section of the ladder, may releasably, windingly store a predetermined additional length of wire when said sections are in a normal non-extended position, such storage unit affording withdrawal of such additional length of wire when the ladder sections are moved to an extended position. Hooks are secured to the ladder sections, where desirable, to hang tools.

5 Claims, 5 Drawing Figures

FIG. 1
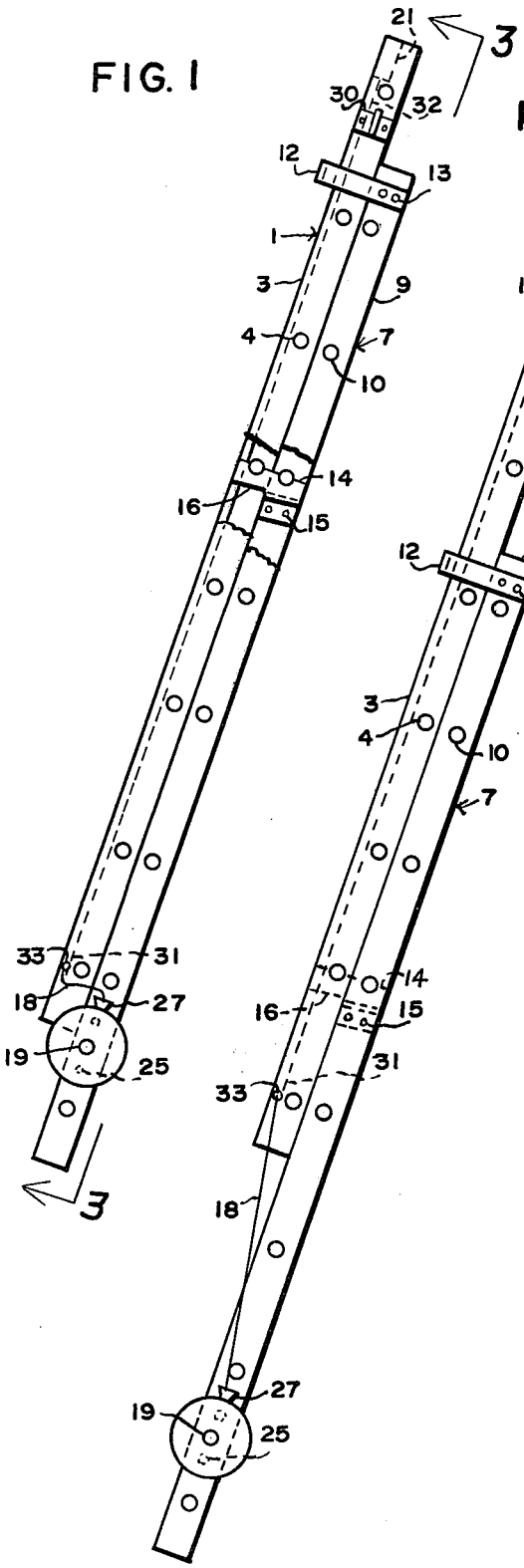
FIG. 2
FIG. 4
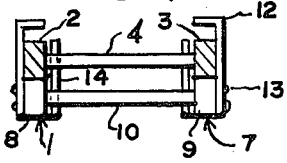
FIG. 5
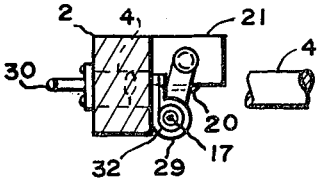
FIG. 3
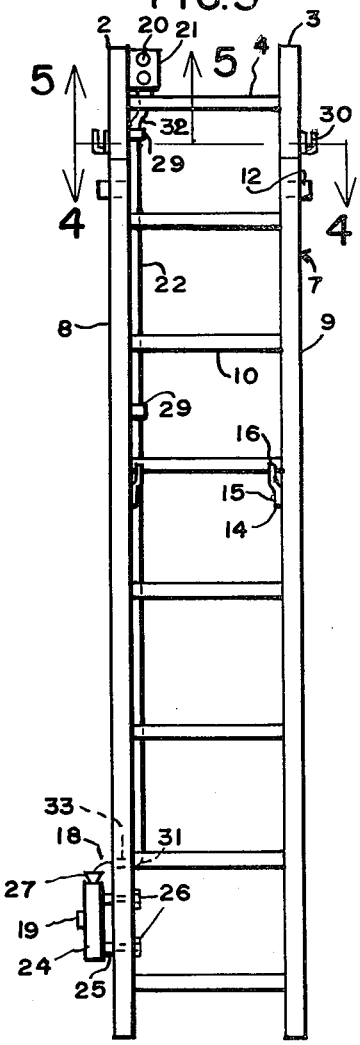

LADDER WITH INSULATED ELECTRICAL CIRCUIT

FIELD OF INVENTION

This invention lies in the field of ladders, and particularly extension ladders, used in construction work, wherein electrically powered tools, such as drills, sanding machines and the like are used.

In prior practice, a person using power tools on an extended extension ladder secured the power tools to an extension cord and climbed the ladder with the extension cord hanging limp and loose, and capable of becoming entangled, or disconnected from the power tool. It has also been necessary to carry the power tool up and down the ladder, entailing some awkward manipulation of both the power tool and the extension cord, and making it more difficult and dangerous to climb up and down the ladder and maintain one's balance.

With the instant invention a person using the ladder has his hands free to drill, sand, nail, and to install electrical fixtures, storm windows, storm doors, etc. Further, this invention eliminates the need of heavy tool belts while on the ladder, since hooks or the like are disposed on the ladder so that tools may hang therefrom. It will not be necessary to carry extension cords up and down the ladder, and it is proposed to ensure that the wire and all of the electrical connections are completely insulated to avoid electrical shock.

SUMMARY OF INVENTION

Invention consists in securing, to a first section of an extensible ladder, a first length of wire to travel with said section when it is moved relative to another section of the ladder, and to provide an additional length of wire to afford such movement.

An object of the invention is to provide an insulating conduit to receive said first wire, to protect against the possibility of electrical shock, particularly upon ladder constructed of metal.

A further object of the invention is to provide a second section of the ladder, a storage unit within which an additional length of wire is stored for withdrawal from said storage unit when said sections of the ladder are moved relative to one another from a normal non-extended position to an extended position.

These and various other objects are attained by the construction hereinafter described, and illustrated in the accompanying drawings, wherein:

FIG. 1 is a side elevational view of a ladder having two sections in a substantially non-extended position, with side members of the ladder broken away to show a rung support.

FIG. 2 is a view similar to FIG. 1 with the two sections of the ladder extended relative to one another.

FIG. 3 is a front elevational view of the ladder taken on line 3—3 of FIG. 1.

FIG. 4 is a horizontal, sectional view of the ladder taken on line 4—4 of FIG. 3.

FIG. 5 is a partial, horizontal, sectional view taken on line 5—5 of FIG. 3, illustrating a conduit and clips for securing said conduit to the ladder, with a rung broken away for clarity of drawing.

In these views, the reference character 1 designates an upper section of an extension ladder, which also has a lower section 7. The upper section is comprised, in the usual manner, of parallel side members 2 and 3, rigidly conjoined by rungs 4, spaced longitudinally of said side members. The lower section 7 is also comprised of parallel side members 8 and 9, similarly conjoined by rungs 10, which are spaced longitudinally of said side members.

"L" shaped brackets 12 are secured to the lower section 7 by rivets, or the like, and have the shorter leg of the "L" extending over the respective side members 2 and 3 of the upper section 1. There are, of course, many ways of associating two sections of an extension ladder so that one section does not escape the other section, but so that each section is movable relative to the other. The "L" shaped members 12 are meant to be merely exemplary, and because the means of so associating two sections of a ladder are numerous, and since any conventional method will suffice, it is not deemed necessary to show great detail in this area.

The lower section 7 is provided on the opposing faces of the parallel side members 8 and 9 with rung support members 14. Said rung support members are secured as by bolts, rivets, screws, or the like 15 to the opposed faces of respective parallel side members 8 and 9, and have a portion 16 spaced inwardly toward each other to minimize friction between the portions 16 and the interior surfaces of the parallel side members 8 and 9 of the upper section 1 of said ladder. The rungs 4 are supported by the rung support members as shown in FIGS. 1 and 2. The ladder is provided with a first length 17 of insulated, electrical wire, extends through an insulating conduit 22, constituted of non-conductive material, such as plastic or the like, and shown only in FIG. 5.

A storage unit 24, of a conventional spring-loaded type, is secured to the outer surface of a parallel side member 8 of the lower section 7 of the ladder. Centrally disposed in a housing of the storage unit is an electrical connection 19, which may rotate with a reel (not shown) disposed interiorly of the storage unit, and which reel is spring-loaded (spring not shown) to wind a length 18 of additional electrical wire into the storage unit.

The storage unit may be provided with post 25 extending through the parallel side member 8, to terminally, threadedly receive nuts 26, whereby the unit 24 is rigidly secured to the lower section 7 of the ladder. At its lower end portion 31 the conduit 22 is bent to pass through a hole 33 formed in the parallel side member 8 of the ladder section 7, so that the additional length of wire 18 may be fed into and out of the storage unit. At its upper end portion 32, the conduit 22 connects in a conventional manner with an electrical box 21, and the wire extending upwardly through the conduit 14 will be secured in the usual, conventional manner to electrical receptacles 20.

A proposed means of securing the conduit 22 to the side member 8 is to use clips 29, which may be simply pieces of strap metal bent to encircle the conduit and have their end portions overlapping so that a nail or screw may extend through said end portions and into the parallel member 8, securing the conduit into position. One such clip is shown in FIG. 3 and is designated as 29, and may be further seen in FIG. 5.

It may be further desirable to add hook members 30 to the upper end portions of the side member 2 and 3 to support tools, or pouches for tools, depending on the nature of the work being done.

The ladder, as shown, is made of wood. If a ladder is made of metal, it will be desirable to employ rubber or plastic caps on the upper and lower end portions of the respective side members. Such caps (not shown) would resist slipping of the ladder on a smooth surface, and also effect a degree of insulation from the surfaces the ladder rests upon and leans against.

The storage unit 24 is formed with a feed tube 27, preferably flared to facilitate admission and withdrawal of wire therethrough into and out of said storage unit. The posts 25 are shouldered to leave a reduced diameter extending through the ladder side member 8. Said reduced diameter is threaded to receive the nuts 26 and mount the storage unit on the ladder.

What I claim is:

1. The combination of a ladder, having at least one section including spaced parallel side members, rigidly conjoined by rungs spaced longitudinally of said side members, an electrically conductive wire, a first connection electrically communicating with said wire, to receive electrical power, a second connection electrically communicating with said wire to transmit electrical power and storage means on said first section to releasably store said wire, for retractable withdrawal of said wire as said sections are extended.

2. The combination as set forth in claim 1, said storage means being adapted to releasably receive and store said wire, as said sections are restored from an extended position to a normal, non-extended position.

3. The combination as set forth in claim 2, a conduit of electrically non-conductive material extending from said storage means, longitudinally of said second section, and a length of said wire being protectively disposed in said section, said length of wire being non-retractable into said storage means.

4. The combination as set forth in claim 3, said second section having at least one elongated member with rungs rigidly spaced longitudinally thereof, said conduit extending along said elongated member, an end portion of said conduit being adapted to coordinate with said storage means to facilitate retraction and withdrawal of the wire from said storage means.

5. The combination as set forth in claim 4, an end portion of said wire being fixed in said storage means and not retractable therefrom, and said first connection being secured to said storage means for electrical communication with said end portion of said wire, whereby, said storage means affords withdrawal therefrom of a desired extent of said wire when said sections are extended, and affords retraction of said desired extent of said wire when said sections are returned to said normal position.

* * * * *